US006575877B2

(12) United States Patent
Rufino et al.

(10) Patent No.: US 6,575,877 B2
(45) **Date of Patent: *Jun. 10, 2003**

(54) EXERCISE TRAINER WITH INTERCONNECTED GROUNDED MOVEMENT

(75) Inventors: John C. Rufino, Whittier, CA (US); Yong Ming Goh, La Verne, CA (US)

(73) Assignee: Unisen, Inc., Irvine, CA (US)

( * ) Notice: Subject to any disclaimer, the term of this patent is extended or adjusted under 35 U.S.C. 154(b) by 342 days.

This patent is subject to a terminal disclaimer.

(21) Appl. No.: 09/740,445

(22) Filed: Dec. 19, 2000

(65) Prior Publication Data

US 2002/0022553 A1 Feb. 21, 2002

Related U.S. Application Data

(63) Continuation of application No. 09/249,189, filed on Feb. 12, 1999, now Pat. No. 6,183,398.
(60) Provisional application No. 60/093,927, filed on Jul. 23, 1998.

(51) Int. Cl.[7] ..... A63B 69/16; A63B 22/04
(52) U.S. Cl. ..... 482/51; 482/52; 482/57; 482/70
(58) Field of Search ..... 482/51, 52, 53, 482/57, 70, 79, 80

(56) References Cited

U.S. PATENT DOCUMENTS

| | | | |
|---|---|---|---|
| 219,439 | A | 9/1879 | Blend |
| 1,909,190 | A | 5/1933 | Sachs |
| 2,603,486 | A | 7/1952 | Hughes |
| 2,826,192 | A | 3/1958 | Mangas |
| 2,892,455 | A | 6/1959 | Hutton |
| 3,316,898 | A | 5/1967 | Brown |
| 3,432,164 | A | 3/1969 | Deeks |
| 3,475,021 | A | 10/1969 | Ruegsegger |
| 3,566,861 | A | 3/1971 | Weiss |
| 3,713,438 | A | 1/1973 | Knutsen |
| 3,756,595 | A | 9/1973 | Hague |
| 3,759,511 | A | 9/1973 | Zinkin |
| 3,824,994 | A | 7/1974 | Soderberg, Sr. |
| 3,970,302 | A | 7/1976 | McFee |
| 4,053,173 | A | 10/1977 | Chase, Sr. |
| 4,185,622 | A | 1/1980 | Swenson |
| 4,188,030 | A | 2/1980 | Hooper |
| 4,379,566 | A | 4/1983 | Titcomb |
| 4,456,276 | A | 6/1984 | Bortolin |
| 4,496,147 | A | 1/1985 | DeCloux et al. |
| 4,509,742 | A | 4/1985 | Cones |
| 4,555,109 | A | 11/1985 | Hartmann |
| 4,561,318 | A | 12/1985 | Schirrmacher |
| 4,592,544 | A | 6/1986 | Smith |
| 4,632,386 | A | 12/1986 | Beech |

(List continued on next page.)

*Primary Examiner*—Stephen R. Crow
(74) *Attorney, Agent, or Firm*—George F. Bethel

(57) ABSTRACT

An exercise trainer having a frame with a flywheel supported on the frame and first and second crank arms having a common axle on the flywheel. A first foot link and a second foot link are respectively connected to the crank arms for pivotal reciprocating movement. The links have channel tracks and an elongated tunnel. Bearing surfaces support the first foot links rearwardly and engage the channels. Foot pedals are mounted on the foot links for relative movement on the foot links. A flexible member such as a belt, cable, or chain is connected to the foot pedal. A lower portion of the flexible member is connected to a fixed location or ground on the frame.

A forward and rearward rotational support such as a pulley receives the flexible member defining a lower portion wrapping around the pulleys and connected to the frame. The pulleys are mounted in the tunnel to provide movement of the foot pedals greater than twice the length of the crank arm.

15 Claims, 10 Drawing Sheets

U.S. PATENT DOCUMENTS

| | | | |
|---|---|---|---|
| 4,643,419 | A | 2/1987 | Hyde |
| 4,645,200 | A | 2/1987 | Hix |
| 4,679,786 | A | 7/1987 | Rodgers |
| 4,685,666 | A | 8/1987 | DeCloux |
| 4,708,338 | A | 11/1987 | Potts |
| 4,709,918 | A | 12/1987 | Grinblat |
| 4,720,093 | A | 1/1988 | Del Mar |
| 4,733,858 | A | 3/1988 | Lan |
| 4,779,863 | A | 10/1988 | Yang |
| 4,786,050 | A | 11/1988 | Geschwender |
| 4,786,068 | A | 11/1988 | Tang |
| 4,786,069 | A | 11/1988 | Tang |
| 4,850,585 | A | 7/1989 | Dalebout |
| 4,869,494 | A | 9/1989 | Lambert, Sr. |
| 4,900,013 | A | 2/1990 | Rodgers, Jr. |
| 4,940,233 | A | 7/1990 | Bull |
| 4,949,954 | A | 8/1990 | Hix |
| 4,949,993 | A | 8/1990 | Stark |
| 4,951,942 | A | 8/1990 | Walden |
| 4,989,857 | A | 2/1991 | Kuo |
| 5,000,442 | A | 3/1991 | Dalebout |
| 5,000,443 | A | 3/1991 | Dalebout |
| 5,039,087 | A | 8/1991 | Kuo |
| 5,039,088 | A | 8/1991 | Shifferaw |
| 5,040,786 | A | 8/1991 | Jou |
| 5,048,821 | A | 9/1991 | Kuo-Liang |
| 5,062,627 | A | 11/1991 | Bingham |
| 5,078,389 | A | 1/1992 | Chen |
| 5,131,895 | A | 7/1992 | Rogers, Jr. |
| 5,135,447 | A | 8/1992 | Robards, Jr. |
| 5,149,312 | A | 9/1992 | Croft |
| 5,163,888 | A | 11/1992 | Stearns |
| 5,186,697 | A | 2/1993 | Rennex |
| 5,195,935 | A | 3/1993 | Fencel |
| 5,238,462 | A | 8/1993 | Cinke |
| 5,242,343 | A | 9/1993 | Miller |
| 5,279,529 | A | 1/1994 | Eschenbach |
| 5,290,211 | A | 3/1994 | Stearns |
| 5,295,928 | A | 3/1994 | Rennex |
| 5,299,993 | A | 4/1994 | Habing |
| 5,320,588 | A | 6/1994 | Wanzer |
| 5,346,447 | A | 9/1994 | Stearns |
| 5,352,169 | A | 10/1994 | Eschenbach |
| 5,383,829 | A | 1/1995 | Miller |
| 5,401,226 | A | 3/1995 | Stearns |
| 5,403,252 | A | 4/1995 | Leon |
| 5,403,255 | A | 4/1995 | Johnston |
| 5,419,747 | A | 5/1995 | Piaget |
| 5,423,729 | A | 6/1995 | Eschenbach |
| 5,496,235 | A | 3/1996 | Stevens |
| 5,499,956 | A | 3/1996 | Habing |
| 5,518,473 | A | 5/1996 | Miller |
| 5,527,246 | A | 6/1996 | Rodgers, Jr. |
| 5,529,554 | A | 6/1996 | Eschenbach |
| 5,529,555 | A | 6/1996 | Rodgers, Jr. |
| 5,540,637 | A | 7/1996 | Rodgers, Jr. |
| 5,549,526 | A | 8/1996 | Rodgers, Jr. |
| 5,549,529 | A | 8/1996 | Rasmussen |
| 5,562,574 | A | 10/1996 | Miller |
| 5,573,480 | A | 11/1996 | Rodgers, Jr. |
| 5,577,985 | A | 11/1996 | Miller |
| 5,591,107 | A | 1/1997 | Rodgers, Jr. |
| 5,593,371 | A | 1/1997 | Rodgers, Jr. |
| 5,593,372 | A | 1/1997 | Rodgers, Jr. |
| 5,595,553 | A | 1/1997 | Rodgers, Jr. |
| 5,611,756 | A | 3/1997 | Miller |
| 5,611,757 | A | 3/1997 | Rodgers, Jr. |
| 5,611,758 | A | 3/1997 | Rodgers, Jr. |
| 5,616,106 | A | 4/1997 | Abelbeck |
| 5,637,058 | A | 6/1997 | Rodgers, Jr. |
| 5,653,662 | A | 8/1997 | Rodgers, Jr. |
| 5,658,227 | A | 8/1997 | Stearns |
| 5,683,333 | A | 11/1997 | Rodgers, Jr. |
| 5,685,333 | A | 11/1997 | Skaryd |
| 5,685,804 | A | 11/1997 | Whan-Tong |
| 5,690,589 | A | 11/1997 | Rodgers, Jr. |
| 5,692,994 | A | 12/1997 | Eschenbach |
| 5,692,997 | A | 12/1997 | Stearns |
| 5,707,321 | A | 1/1998 | Maresh |
| 5,733,227 | A | 3/1998 | Lee |
| 5,735,773 | A | 4/1998 | Vittone |
| 5,735,774 | A | 4/1998 | Maresh |
| 5,738,614 | A | 4/1998 | Rodgers, Jr. |
| 5,741,205 | A | 4/1998 | Doll |
| 5,743,832 | A | 4/1998 | Sands |
| 5,743,834 | A | 4/1998 | Rodgers, Jr. |
| 5,746,683 | A | 5/1998 | Lee |
| 5,749,809 | A | 5/1998 | Lin |
| 5,755,642 | A | 5/1998 | Miller |
| 5,755,643 | A | 5/1998 | Sands |
| 5,755,645 | A | 5/1998 | Miller |
| 5,759,135 | A | 6/1998 | Chen |
| 5,759,136 | A | 6/1998 | Chen |
| 5,762,588 | A | 6/1998 | Chen |
| 5,766,113 | A | 6/1998 | Rodgers, Jr. |
| 5,769,760 | A | 6/1998 | Lin et al. |
| 5,772,558 | A | 6/1998 | Rodgers, Jr. |
| 5,776,035 | A | 7/1998 | Chen |
| 5,779,598 | A | 7/1998 | Lee |
| 5,779,599 | A | 7/1998 | Chen |
| 5,782,722 | A | 7/1998 | Sands |
| 5,788,609 | A | 8/1998 | Miller |
| 5,788,610 | A | 8/1998 | Eschenbach |
| 5,792,026 | A | 8/1998 | Maresh |
| 5,792,028 | A | 8/1998 | Jarvie |
| 5,792,029 | A | 8/1998 | Gordon |
| 5,795,268 | A | 8/1998 | Husted |
| 5,800,315 | A | 9/1998 | Yu |
| 5,803,871 | A | 9/1998 | Stearns |
| 5,803,872 | A | 9/1998 | Chang |
| 5,813,949 | A | 9/1998 | Rodgers, Jr. |
| 5,820,524 | A | 10/1998 | Chen |
| 5,823,914 | A | 10/1998 | Chen |
| 5,823,917 | A | 10/1998 | Chen |
| 5,823,919 | A | 10/1998 | Eschenbach |
| 5,830,112 | A | 11/1998 | Wang |
| 5,836,854 | A | 11/1998 | Kuo |
| 5,836,855 | A | 11/1998 | Eschenbach |
| 5,846,166 | A | 12/1998 | Kuo |
| 5,848,954 | A | 12/1998 | Stearns et al. |
| 5,857,940 | A | 1/1999 | Husted |
| 5,857,941 | A | 1/1999 | Maresh et al. |
| 5,860,895 | A | 1/1999 | Lee |
| 5,865,712 | A | 2/1999 | Chang |
| 5,868,650 | A | 2/1999 | Wu |
| 5,876,307 | A | 3/1999 | Stearns |
| 5,876,308 | A | 3/1999 | Jarvie |
| 5,879,271 | A | 3/1999 | Stearns et al. |
| 5,882,281 | A | 3/1999 | Stearns et al. |
| 5,893,820 | A | 4/1999 | Maresh et al. |
| 5,895,339 | A | 4/1999 | Maresh |
| 5,899,833 | A | 5/1999 | Ryan et al. |
| 5,911,649 | A | 6/1999 | Miller |
| 5,913,751 | A | 6/1999 | Eschenbach |
| 5,916,064 | A | 6/1999 | Eschenbach |
| 5,916,065 | A | 6/1999 | McBride |
| 5,919,118 | A | 7/1999 | Stearns et al. |
| 5,921,894 | A | 7/1999 | Eschenbach |
| 5,924,962 | A | 7/1999 | Rodgers, Jr. |
| 5,924,963 | A | 7/1999 | Maresh |
| 5,928,114 | A | 7/1999 | Chen |

5,938,567 A 8/1999 Rodgers, Jr.
5,938,568 A 8/1999 Maresh et al.
5,938,570 A 8/1999 Maresh
5,947,872 A 9/1999 Ryan et al.
5,957,814 A 9/1999 Eschenbach
5,961,423 A 10/1999 Sellers
5,967,944 A 10/1999 Vittone
5,971,892 A 10/1999 Lee
5,989,159 A 11/1999 Chen
5,993,359 A 11/1999 Eschenbach
5,997,445 A 12/1999 Maresh
6,004,244 A 12/1999 Simonson
6,007,462 A 12/1999 Chen
6,017,294 A 1/2000 Eschenbach
6,019,710 A 2/2000 Dalebout
6,022,296 A 2/2000 Yu
6,024,676 A 2/2000 Eschenbach
6,027,430 A 2/2000 Stearns
6,027,431 A 2/2000 Stearns
6,030,320 A 2/2000 Stearns
6,042,512 A 3/2000 Eschenbach
6,045,487 A 4/2000 Miller
6,045,488 A 4/2000 Eschenbach
6,053,847 A 4/2000 Stearns
6,063,008 A 5/2000 McBride
6,063,009 A 5/2000 Stearns
6,077,196 A 6/2000 Eschenbach
6,077,198 A 6/2000 Eschenbach
6,080,086 A 6/2000 Maresh
6,090,013 A 7/2000 Eschenbach
6,090,014 A 7/2000 Eschenbach
6,099,439 A 8/2000 Ryan et al.
6,113,518 A 9/2000 Maresh
6,123,650 A 9/2000 Birrell
6,126,573 A 10/2000 Eschenbach
6,126,574 A 10/2000 Stearns
6,135,923 A 10/2000 Stearns
6,135,926 A 10/2000 Lee
6,135,927 A 10/2000 Lo
6,142,915 A 11/2000 Eschenbach
6,146,313 A 11/2000 Whan-Tong et al.
6,146,314 A 11/2000 Lee
6,149,551 A 11/2000 Pyles et al.
6,152,859 A 11/2000 Stearns
6,159,132 A 12/2000 Chang
6,165,107 A 12/2000 Birrell
6,168,552 B1 1/2001 Eschenbach
6,171,215 B1 1/2001 Stearns
6,171,217 B1 1/2001 Cutler
6,176,814 B1 1/2001 Ryan et al.
6,183,397 B1 2/2001 Stearns et al.
6,190,289 B1 2/2001 Pyles et al.
6,196,948 B1 3/2001 Stearns

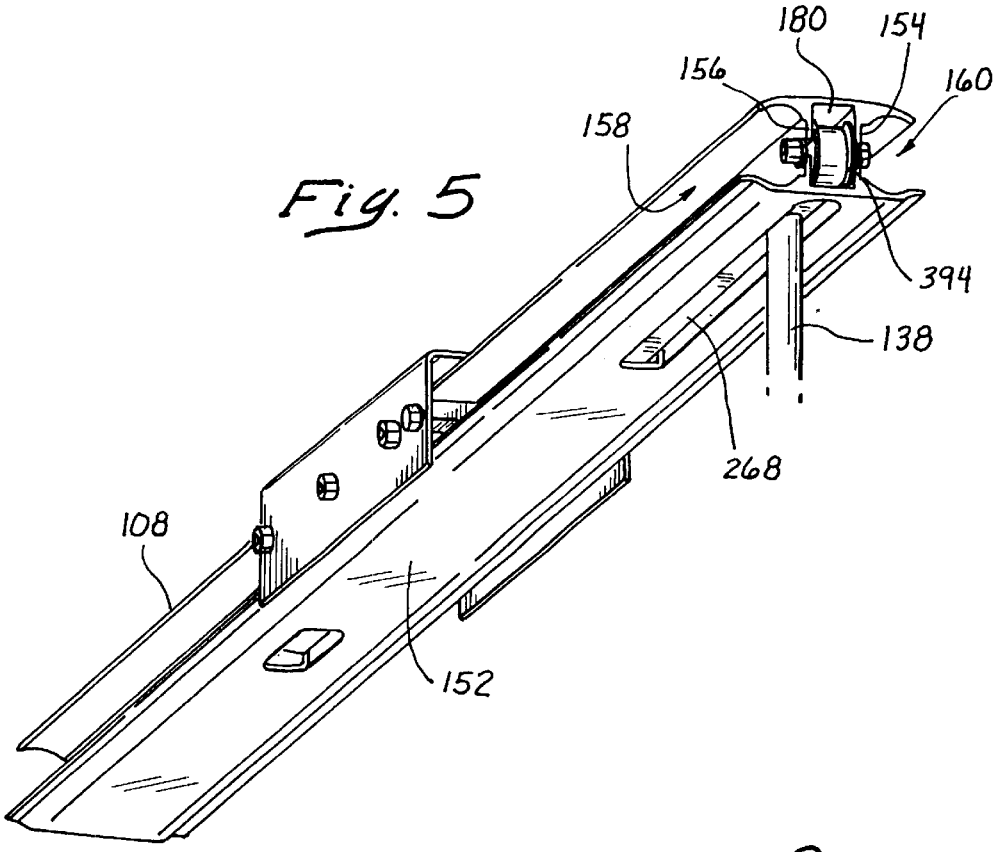
Fig. 5
Fig. 8
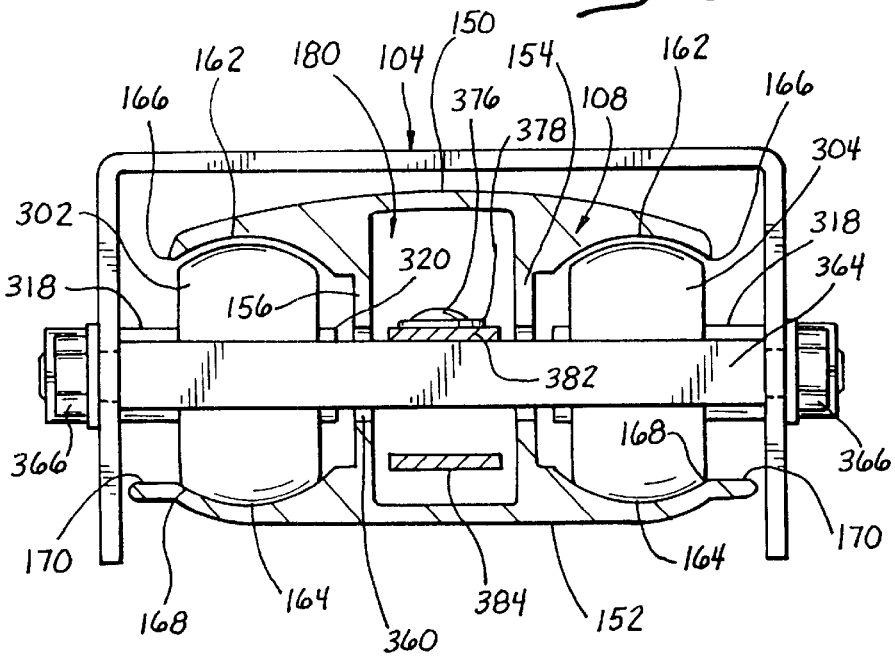

EXERCISE TRAINER WITH INTERCONNECTED GROUNDED MOVEMENT

This is a continuation of application Ser. No. 09/249,189, filed Feb. 12, 1999 now U.S. Pat. No. 6,183,398.

This application claims the benefit of U.S. Provisional Application No. 60/093,927 as filed Jul. 23, 1998.

BACKGROUND OF THE INVENTION

1. Field of the Invention

This invention pertains to exercise apparatus which is in the form of a trainer that provides a simulated walking or running stride. The trainer of this invention falls within the field of exercise devices such as stepping machines, simulated cross country ski machines, stationary bicycles, as well as other types of exercise trainers. It more particularly relates to those types of exercise trainers within the art and background related to pedals that can be reciprocated as attached to a pair of cranks to provide for a simulated walking or running motion. In particular, it relates to those training and exercise devices which approximate an elliptical motion with respect to a user's foot movements.

2. Prior Art

Exercise and training devices come in many forms. As is generally known, such exercise devices can include stationary bicycles such as those of the reclining and vertical type. Further to this extent, there are such devices that are simulated stepping machines which allow one to step upwardly and downwardly to simulate a climbing of stairs. Also well known are treadmills that simulate running, jogging, and walking vigorously.

There are other well known devices that not only include cycling but also efforts related to treadmill workouts.

Treadmills generally permit a user to walk, jog or run on a stationary machine. However, they are considered impact devices which in some cases are not as beneficial to the user as for example a low impact device such as a bicycle whether it be a reclining or vertical bicycle or such stepping machines as are known in the art.

There are exercise trainers that are currently known in the art that simulate a running, walking, or jogging effort on a pair of pedals. These pedals are physically connected to cranks that are under a load.

It is preferable, that such exercise trainers have their pedals trace a path approximating an ellipse or what can be considered as a modified elliptical path. One of the drawbacks of such modified elliptical paths is that the major axis of the path is limited to being shorter than twice the crank's length. This is due to the fact that the axis of the crank as it turns a wheel or other device when considered with the axis of the connection at the end of the crank limits the overall stroke distance which forms the major axis of the modified elliptical path to that distance minus the axial orientations.

For example to achieve a sixteen inch length in the major axis of an elliptical like trainer, such cranks of a trainer need to have a longer crank length than half the length which would be eight inches. This takes into account the journaling and bearing mountings. From a practical standpoint in order to provide a sixteen inch length of the major axis of the modified elliptical path, a nine inch long crank must be utilized to provide approximately an eighteen inch diameter circle.

When the foregoing translates to the diameter of the wheel or disk under load that is being driven, it creates a significantly high pedal step up. In effect, to move or run at a sixteen inch stride even with such a large diameter disk or wheel utilizing the nine inch long crank shaft, the effect is that of a diminished step that could be analogized to a "baby step". It has been found in the past that this did not provide sufficient aerobic effort nor provide for enough hip flexure to maximize a cardiovascular workout through the leg, hip, quadriceps, and other muscle portions of the body.

Much of the prior art relies upon foot pedals that rigidly attach to foot links. These foot links are generally in connected relationship to the ends of the cranks. Usually there is little or no relative motion between the foot pedals and the foot links. This serves to limit the major axis as to the length of the major axis of the modified elliptical path inscribed by the foot pedal.

In order to overcome the deficiencies of the prior art, this invention utilizes a unique relative motion concept with respect to the foot links and the foot pedals. The invention in order to accomplish this, utilizes a foot pedal mounted with rollers on the foot link. The foot pedals are oriented with the foot links by means of these rollers which travel in a concave channel along the length of the foot link. This traveling of the rollers in the concave channels allows relative motion when the foot pedal has been maintained by a relationship to a ground or non-moving portion. The foot pedal moves in relationship to a fixed or grounded area such as to the frame.

In order to maintain this relative movement relationship, a flexible belt like element that can be in the form of a belt, chain, cable, or other member allows the foot pedal to slide relative to the foot link as the foot link reciprocates backwardly and forwardly. In effect, the flexible member pulls the foot pedal relative to the foot link in the direction of foot link travel. The net effect is to increase the stride length by a factor of four. The normal relative movement would be two times the crank length.

The net result of the foregoing is to create a movement whereby the foot links with the flexible member when moving backwardly cause a pulling of the foot pedals backwardly along the length of the foot link. This creates a stride with a modified elliptical motion while at the same time maintaining a small crank diameter such that the major axis of the modified ellipse is four times the length of the crank.

As will be seen hereinafter, this invention is a significant step over the art and can be modified by various belt or flexible member orientations with regard to the ground and the flexible member as well as the movement of the foot link.

SUMMARY OF THE INVENTION

In summation, this invention comprises an exercise trainer having a load applied to a rotational disk or wheel connected to cranks which are in turn connected to a pair of foot links having foot pedals which are provided with relative movement to multiply the distance which the foot links move through a relative movement of the foot pedals in relationship to the foot links.

More specifically, the invention incorporates a pair of foot links which are supported on rollers at one end for reciprocating movement thereon. At the other end, the foot links are attached to a pair of cranks. Each respective crank has a bearing for attachment of the foot links for rotational movement with regard to the cranks as journaled thereon. The cranks are connected to a wheel or disk. The wheel or disk is in turn connected to a loading device which can be in the form of a mechanical load, such as a brake applied to the wheel, or in the alternative, and preferably, an electromechanical load such as an alternator. The alternator can have its output connected to a resistance bank which in turn can be a variable resistance bank to change the load on the alternator and the attendant wheel and disk and attached cranks.

Each foot link is formed as an extrusion having channels therein and an open center tunnel or passage portion. The channels are such where they can support and guide the foot pedals on rollers. Further to this extent, the channels also provide for a movement on rollers at a distal end from the crank arms. The channels in effect, allow the rollers to be engaged internally and support the foot link as it reciprocates backwardly and forwardly on the rollers in a reciprocating and at the same time a pivoting manner thereon.

The entire trainer is supported on an underlying frame. Attached to the frame is a ground point which extends upwardly into the central cross-sectioned tunnel area of the foot link. The ground point can extend from a post or columnar support or other means through the cross-sectional area of the foot link which is cut away in the form of an elongated slot. The ground point allows for attachment of a flexible member in a fixed grounded relationship. The flexible member is comprised of a belt, chain, cable, or other means to allow the relative movement of the foot link to pull the foot pedal or drive it backwardly as the foot link oscillates in a reciprocal movement.

The foregoing reciprocal oscillating movement of the foot link accommodates the flexible member by having the flexible member looped and carried as a continuous member around two support pulleys at either end. The support pulleys allow for the flexible member to move around them and at the same time be driven by the foot link.

Attached to the foot pedal is an anchor bar or other structural anchoring means to which the flexible member is attached in a fixed manner. The flexible member is also anchored to the frame to form a fixed location relative to motion of the food pedal. In this manner, as the foot link reciprocates backwardly, it tends to drive the flexible member in relative movement internally of the cross-sectional tunnel area pulling the foot pedal at the flexible member anchoring point or anchor bar. The foregoing relative motion provides for a doubling motion to increase the reciprocal movement of the foot pedal to four times that of what would normally be the distance of the crank length.

Alternative embodiments of this invention also incorporate extended flexible member features whereby the flexible member can be looped around multiple rollers connected to the foot link so as to allow the reciprocal movement to be multiplied by a factor of six or eight times the crank length. Also, various apparatus can be used to limit the movement of the flexible member below its total length of reciprocation so that it can be diminished.

BRIEF DESCRIPTION OF THE DRAWINGS

FIG. 5 shows a view looking upwardly at the foot link and foot pedal in a perspective view whereby the ground point is shown extending through a slot within the foot link.

FIG. 8 shows an end view of the foot pedal as sectioned and seen in the direction of lines 8—8 of FIG. 3.

DESCRIPTION OF THE PREFERRED EMBODIMENTS

Figure 1:
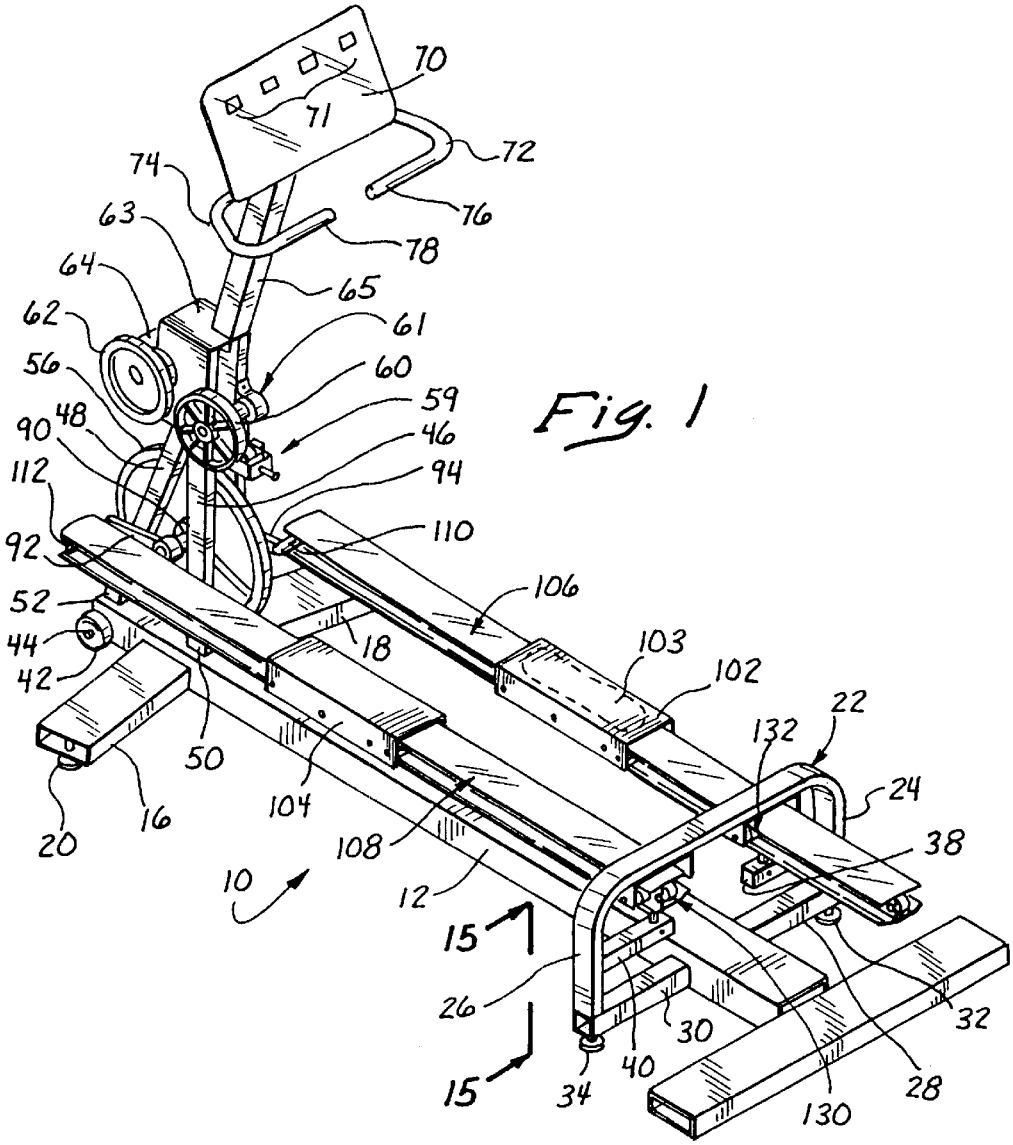
FIG. 1 shows a perspective view of the exercise trainer of this invention with the moving elements connected to a stand which can be used to support the arms of a user.

Looking more particularly at FIG. 1, which is a perspective view showing the exercise trainer of this invention, it can be seen that a frame 10 is generally shown having a longitudinal base member 12. The longitudinal base member 12 terminates at an end portion 14 forming a T shaped cross member at the rear thereof.

At the front, a pair of angular cross members 16 and 18 are shown. These angular cross members 16 and 18 are welded to the longitudinal frame member 12. Angular cross members 16 and 18 have leveling pads 20 on either side. The leveling pad of cross member 18 is hidden from view but is identically placed as the leveling pad 20 of cross member 16. These tend to level and orient the frame 10 and the attendant exerciser supported thereon.

In order to support the foot links at the rear, an inverted U shaped frame 22 is provided. The inverted U shaped frame member 22 has a horizontal portion and two depending portions 24 and 26. These vertical or upright portions 24 and 26 respectively terminate in a pair of box extension frame members 28 and 30. The respective box extension frame members 28 and 30 are welded or suitably bolted to the longitudinal member 12 to provide stability to the entire frame 10.

Welded to the horizontal portion of the U shaped frame 22 is the main support roller bracket 198, containing main support rollers 190 and 192.

Welded to and extending from the upright portions 24 and 26 are the left and right grounding shafts 138 supports 38 and 40. The grounding shaft supports 38 and 40 respectively extend inwardly in a lateral manner from the uprights 24 and 26. These extending inwardly oriented members 38 and 40 are such wherein they provide a ground for the flexible member. The ground extends from members 38 and 40 down through the uprights 24 and 26 to the base of the frame as leveled and set upon the leveling pads 32 and 34.

In order to provide for a level orientation, the cross members 28 and 30 respectively have leveling pads 32 and 34. These allow for leveling of the entire frame comprising cross members 16, 18 and 30 and 32 along with the terminal T shaped portion 14.

Connected to the front of the longitudinal member 12 is a pair of rollers 42 which is journaled with a pin 44 so that the frame 10 in its entirety can be rolled along.

The frame 10 supports an upright member 46 braced by an angular member 48. The upright member 46 and angular member 48 are welded or secured in any suitable manner such as rivets, bolts, or metal flange inserts and mating slots into the base member 12. This can be seen where they are secured at portions respectively 50 and 52. As an aside, the securement of the various metal frame members can be made by welding, bolts, rivets, inserts, tabs, locking tabs, plastic joiners, or linking connectors which are well known in the art.

The upright 46 and the bracing member 48 is provided on both sides of the drive pulley disk or wheel 56.

In this case the braking or load is provided by means of an electric or mechanical loading system, alternator, generator, rheo, magnetic, eddy current, etc. In the alternative, a mechanical brake such as caliper brakes known in the art can be used to squeeze the rim of the disk or wheel 56.

In this particular case, the drive pulley 56 is operationally connected by a belt to a pulley or sheave 60 which in turn is connected by a second belt to a second pulley or sheave 62. The second pulley or sheave 62 is also the flywheel attached to the mechanical, electrical or electro-magnetic load device, alternator, generator, rheo, magnetic, etc. This device provides resistance to the flywheel which in turn provides resistance to the crank pulley 56. As the crank pulley rotates, its energy is transmitted to the flywheel and stored. This stored energy will provide the inertia and will be constantly transmitted back to the crank pulley to create a smooth motion to the user.

The resistance can be changed by requiring the loading device to increase the resistance. Thereby changing the load on the drive pulley 56 and the reflective load to the foot links.

In order to allow the user full access to variations and resistance, a panel 70 which includes a switch bank 71 is shown. The panel 70 is merely for descriptive purposes but can include various inputs in the way of mechanical electronic or touch switches so that variations in resistance can take place. In order to allow for the user to have access and balance oneself, a pair of handle bars 72 and 74 are shown to which the user can grip at handle portions 76 and 78. Thus, a grip can be maintained and at the same time changes in loading can take place by the switch means that can be emplaced on the panel 70 such as switches in the form of the switch bank 71 that are shown.

The drive system through the sheaves or pulleys 60 and 62 can be interconnected by any suitable drive including the journal housing 61 as shown having the bearing support for the sheave 60. Also, various controls can be utilized to tension the belt connected between crank pulley and sheave 60 through the idler pulley 59 as shown. To this extent, also frame members can be utilized other than frame members shown including the upright support 65 connected to the rigid support box 63 which is in turn welded or connected to the upright 46 and bracing member 48. Also, parallel bracing members on the other side such as those symmetrically opposite upright 46 and angular bracing 48 can be included.

The exercise trainer hereof is such wherein a user positions oneself on the exerciser foot pedal portions 102 and 104. The foot pedal portions 102 and 104 are supported on pedal links 106 and 108. The pedal links 106 and 108 comprise extruded beam or drive rod portions in the form of an extrusion having a central cross-sectional area formed as a general channel, tunnel, or void 180 and two channel portions 158 and 160 on either side. These will be detailed hereinafter in the cross-sectional showings of the extrusion.

Each of the pedal links 106 and 108 are connected respectively to their crank members 94 and 92 by means of journaled pivoting crank arm journaled extensions 110 and 112. The crank extensions 110 and 112 extend into openings and bearings within the foot links 106 and 108 as can be seen in the bearing guide shown in FIG. 4, namely bearing guide 113. These crank arm journaled extensions 110 and 112 can be formed as any crank arm extension providing for a pivotal or rotational journaled attachment to the crank arms 92 and 94 so as to create a rotational end member in the form of the crank extensions 110 and 112 analogous to those of a bicycle pedal support. The extensions 110 and 112 are pivotally connected and journaled by bearings to the pedal links 106 and 108 at bearings 113.

The foregoing allows the pedal links to move in a reciprocating manner on the rotationally supported bearings or shafts 110 and 112. This reciprocating motion can be analogous to any reciprocators which are attached to a rotational movement for translation of rotational movement by a crank into reciprocating movement such as is well known in the form of pitman rods, crank connections, drive shafts and other forms for creating reciprocating motion from rotational motion.

Mounted on the pedal links 106 and 108 are the two respective pedal portions 102 and 104. The pedal portions can be formed in any suitable manner. However, in this case they are shown as inverted box shaped 90° U shaped members or rectangular channels. The box shaped or rectangular channel members forming the pedal portions 102 and 104 are provided with some means for receiving a user's foot. This has been shown in the form of the outline 103 on pedal portion 102 that can be a foot pad with a heel cup, a cup shaped element with upstanding lips, or lipped edges, or a shoe like member into which a user's foot can be emplaced. The foot pedals 102 and 104 are such wherein they support a user's foot which can be connected in any particular manner or received on top in the form of a foot conforming portion such as outline 103.

Figure 13:
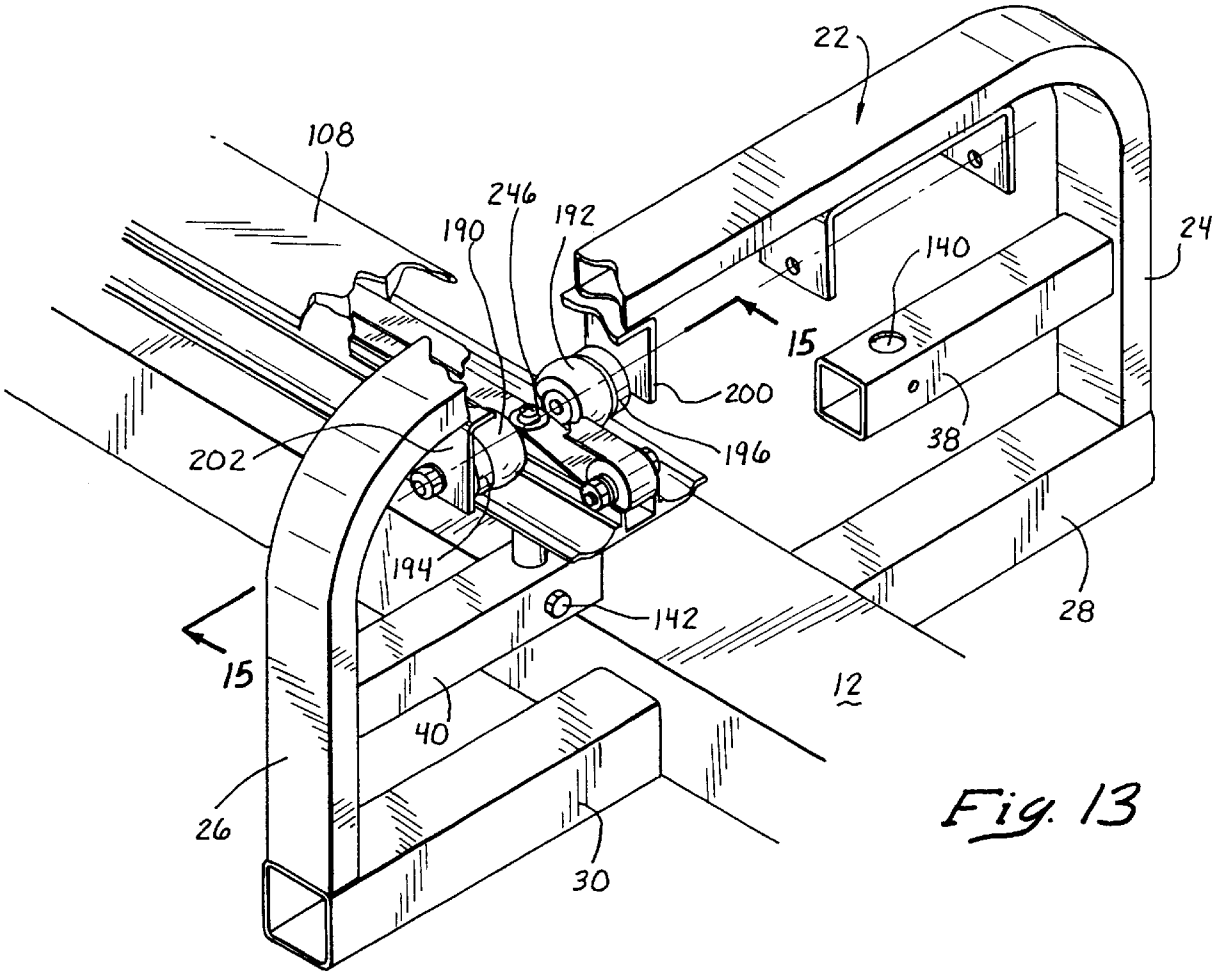
FIG. 13 shows a fragmented perspective view with the support frame broken away to detail the end rollers which support the foot link as well as the pulley upon which the flexible member is wrapped around.
Figure 15:
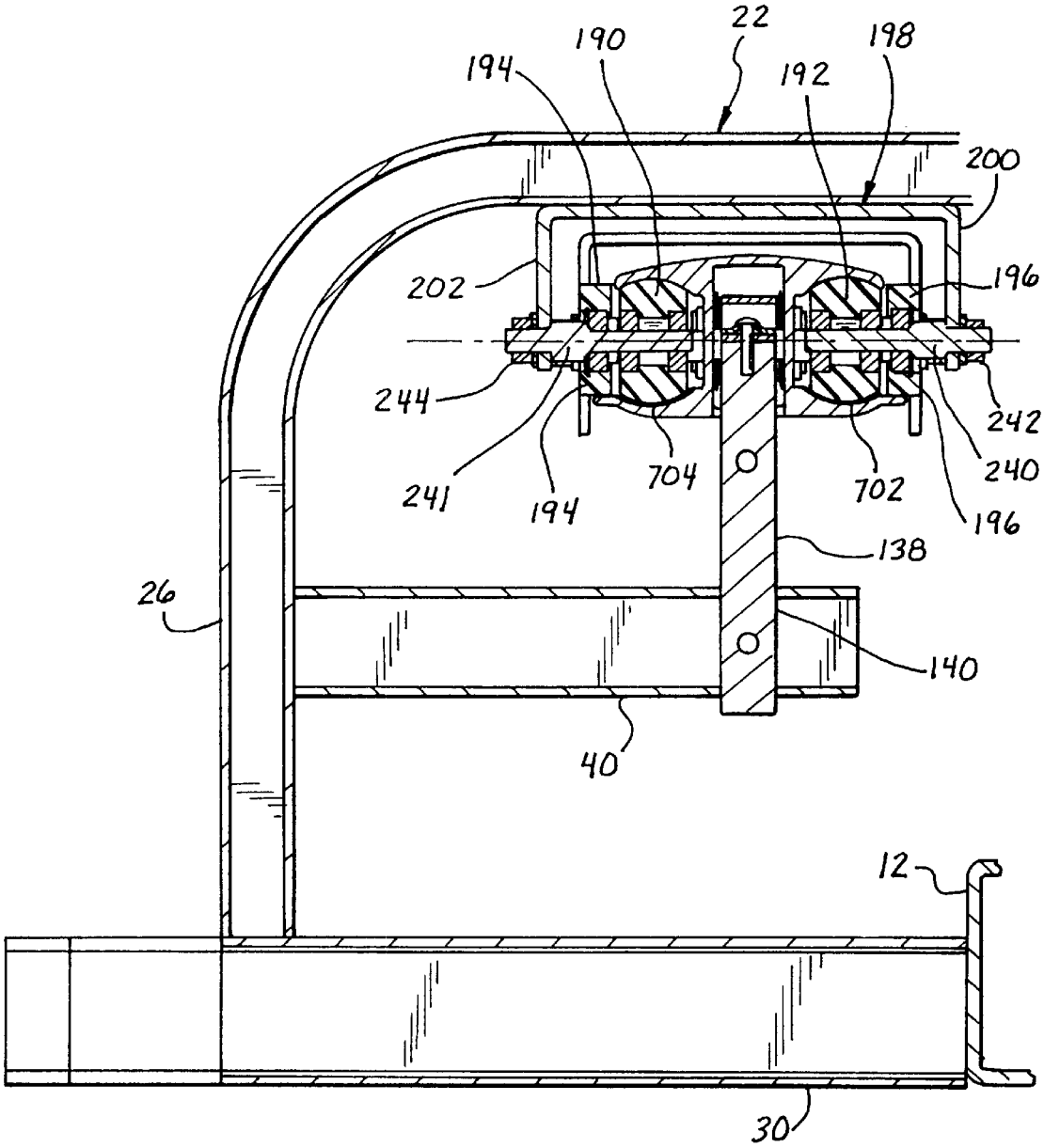
FIG. 15 shows a sectional view of the rear support rollers supporting the foot link as sectioned along lines 15—15 of FIG. 1.

At the distal end from the cranks 92 and 94, the pedal links 106 and 108 are supported on a grouping of rollers 130 and 132 having rollers which will be detailed hereinafter. In order to view the roller groupings 130 and 132 more carefully, a view thereof can be seen in greater detail in FIGS. 13 and 15. FIG. 13 is a perspective fragmented view thereof showing support of the pedal link 108. This can be seen clearly wherein the inverted U shaped portion 22 with its uprights 24 and 26 are shown supporting the underlying lateral ground support member 40. Extending from the ground support member 40 is a ground or upright column 138. The ground support, or upright member 138 is seated within an opening shown analogous to that of opening 140 having a pin or other means such as a bolt 142 passing therethrough and securing it. The ground 138 can be connected to anything so long as it provides suitable ground connection as will be detailed hereinafter. At its non-grounded end, ground 138 attaches to a flexible member so that a portion of the flexible member does not move with respect to ground as the foot link 108 reciprocates backwardly and forwardly.

In order to support the foot link 108, it can be seen that the roller system or grouping 130 has been shown which is analogous to roller system or grouping 132 which supports foot link 106.

Figure 6:
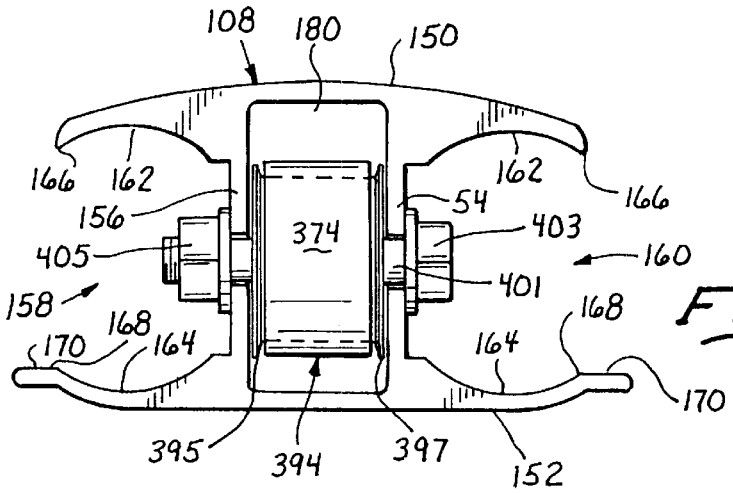
FIG. 6 shows an end view of the foot link as seen in the direction of lines 6—6 of FIG. 4.

In order to facilitate understanding of the support on the roller support system 130, it should be understood that the foot link 108 comprises an elongated beam like section that has been extruded with a pair of channels 158 and 160 on either side, and with an internal elongated tunnel chamber or passage 180. In particular, looking at FIGS. 4, and 5, it can be seen wherein the foot link 108 is shown having an upper slightly curved flat portion 150 and a lower portion 152. The upper and lower portions 150 and 152 are joined by a pair of internal webs 154 and 156. These internal webs 154 and 156 can be seen more specifically in FIGS. 6, 7 and 8 which shows the end and cross-sections of the foot link 108.

In particular, webs 154 and 156 interconnect the upper portions 150 and 152 so that a pair of channels 158 and 160 are provided. The channels 158 and 160 have upper and lower convex curvilinear surfaces 162 and 164 respectively at the tops and bottoms thereof. These curvilinear convex internal surfaces 162 and 164 allow for a generally rounded seating of rollers which roll therein and capture them at the outer limits or downturned and upturned lips respectively 166 and 168.

Extending from the upturned lips 168, are a pair of flat surfaces 170 which are bilaterally symmetrical and allow for secondary guide rollers to be received on the flat surfaces thereof. Thus, the foot link 108 comprise two channel portions 158 and 160 divided by upright webs 154 and 156 and also have a tunnel, elongated cavity, or interior passage 180 passing therethrough. The interior passage 180 is such where it receives a flexible member to be detailed hereinafter.

The foot link extrusion 108 can be formed in any suitable manner. The criteria is that it be able to reciprocate either on rollers, links, or other means. For instance, a mechanical linkage can be utilized in the form of arms on which the foot link 108 moves backwardly and forwardly. In this manner, movement of the foot link reciprocally can be in any manner to provide for reciprocal movement, as well as by pneumatic and fluidic means in the form of pistons, cylinders, or other supports. Any such support means in order to allow the foot link 108 to move backwardly and forwardly can be utilized for reciprocating movement of the foot links 106 and 108 with respect to the rotational movement of the cranks 92 and 94. In effect, it is not necessary to have the support roller system 130 and 132 or the configuration of the foot links 106 and 108 as shown as long as a sliding reciprocal and tilting or other movement can be established such as on a pivoting upright support member or link which rotates backwardly and forwardly such as a bell crank member, upright pneumatically pivoting strut, or arcuately turning extension member connected to a pneumatic or hydraulic damper.

In order to support the foot link 108 in the channels 158 and 160, a pair of main support rollers 190 and 192 are utilized. These respective rollers 190 and 192 are received respectively within the channels 158 and 160. These rollers 190 and 192 have a partial curvilinear cross-section which generally conforms to the upper and lower channels respectively 162 and 164. Thus smooth rolling contact is established while at the same time engaging and checking the movement of the foot link 108 from lateral sway.

Rollers 190 and 192 are machined slightly smaller in diameter than the opening of 162 and 164 as seen in gaps 702 and 704. These gaps 702 and 704 allow clearance between rollers 190 and 192 and foot links 108 to provide a smooth and quiet rolling.

The rollers 190 and 192 fundamentally are such wherein they support the foot links 106 and 108 in their reciprocal movement and are assisted by means of two flat rollers 194 and 196. These flat rollers 194 and 196 can be seen in greater detail in FIG. 15. These particular flat rollers are designed to have a smaller gap from the flat surface 170 on the extrusion. During normal operation, as the user's weight presses down on the foot links, only the main support roller is in contact and rolling as the foot links reciprocate. Any uplifting force on the foot links during the operation will disengage the extrusion from the main support rollers 190 and 192 and extrusion's flat 170 will roll on the flat rollers 194 and 196.

The rollers 190, 192, 194 and 196 are supported for movement by a depending bracket 198 that has two lateral depending walls or bracket portions 200 and 202. The depending bracket portions 200 and 202 have openings which receive a pair of axles 240 and 241. These are secured by nuts 242 and 244 respectively to provide a journaled bearing surface by axles 240 and 241 upon which bearings of the rollers 190, 192, 194 and 196 can turn.

The rollers 190, 192, 194 and 196 can be journaled on any type of bearing surface with ball bearings, roller bearings, or merely a friction bearing. The main support rollers 190 and 192 are shown also provided with bearings internal thereof attached to their axles 240 and 241 for rolling movement. The rollers 190 and 192 are retained by any means to the ends of the axles 240 and 241.

The foregoing roller and support configuration provided by the rollers 190 and 192 support the interior surfaces of the channels 162 as they rest thereon. To further enhance the operation, the flats or extensions 170 in conjunction with rollers 194 and 196 allow for rigidifying and maintenance of the movement of the foot links so that the combination maintains the foot links with regard to upper and lower movement and stability in both vertical directions. This is based upon the rollers 194 and 196 being journaled and engaging the flats 170 by downwardly rolling forces.

The upright ground member 138 as previously mentioned passes upwardly through the foot links 108 and is received within a slot 260 which can be seen in greater detail in FIG. 5 as a slot in the underlying surface 152 of the foot link 108. This allows for reciprocating movement of the foot link 108 with the upright ground member 138 passing through the slot 260. This permits a connection of the ground to a flexible member which will be detailed hereinafter which serves to move the foot pedals 102 and 104 in relative motion to the foot links 106 and 108.

The foot pedals 102 and 104 can be seen as supported on the foot links 106 and 108 in the various showings hereof. Specifically, foot pedal 104 has been shown on foot link 108 supported by three pairs of rollers. The rollers at the front and back respectively provide the underlying support at the front and the back when rolling on respective channels 164. These particular rollers can be seen as rollers 302 and 304 sectioned in the direction of lines 8—8 of FIG. 3 so that they are detailed in FIG. 8. These rollers 302 and 304 are matched by a second pair of rollers at the front area of the foot pedal 104. Each pair of rollers is supported by an axle such as axle 306 at the rear and axle 308 that are secured by nuts on either side. These nuts are analogous to nuts 340 shown in FIG. 7 and can be substituted by flanged fittings, cap nuts, or other means for securing the axle 306 with the rollers 302 and 304 thereon. These rollers 302 and 304 have bearing surfaces which allow them to roll on the axle or in the alternative, the axle can be seated and journaled in the foot pedal 104 so as to provide for rotational axial movement. The respective rollers 302 and 304 and those on axle 308 which are not shown ride in the channels 164 to provide resting support for the foot pedal 104 as it moves backwardly and forwardly.

The rollers 302 and 304 are secured by spacers 318, or bearings and end securements 320 on either end or side thereof. Other suitable means such as bearing locks, caps, or other means can be utilized. Suffice it to say, the rollers 302 and 304 move backwardly and forwardly with rollers on axle 308 and support the foot pedal 104 on the foot link 108 insofar as the pair of rollers mounted on axles 306 and 308 are concerned.

Figure 7:
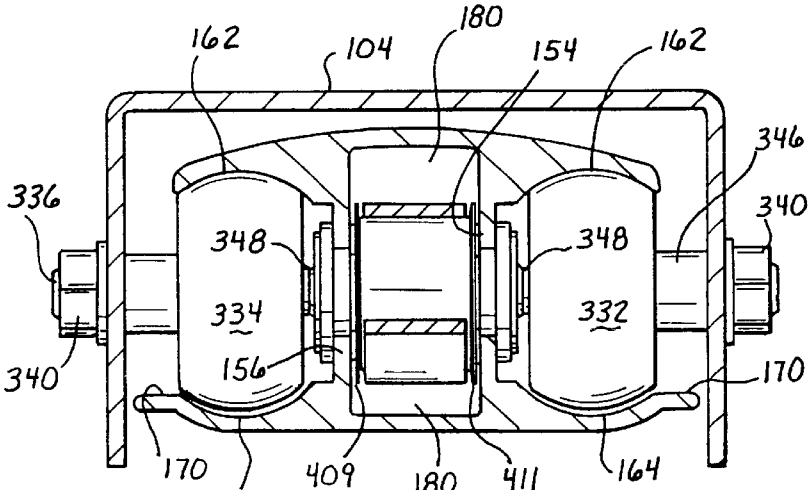
FIG. 7 shows a sectional view of the foot pedal and roller supports as sectioned along lines 7—7 of FIG. 3.

The third set of rollers shown in the sectional view of FIG. 7 are rollers 332 and 334 which are also supported on an axle 336 passing through the foot pedal 104. This axle 336 allows for the rollers 332 and 334 to ride thereon. Axle 336 in like manner to axles 306 and 308 is secured by a nut 340 on either end and includes spacers and bearings respectively 346 and 348.

The rollers 332 and 334 are offset with regard to their axles in an upward manner from the axles 306 and 308. In this manner, they exert an upward force against the arcuate convex channel portions 162. The rollers 332 and 334 provide this upward lifting force in such a manner as to create a tightened or snug mounting of the foot pedal 104 on the foot link 108 by the central portion pushing upwardly on the foot link 108 as the foot pedal 104 is loaded downwardly against the trough or curved portion 164 of the channels by the rollers and axles 306 and 308. This can be seen by the space beneath rollers 332 and 334 in FIG. 7. This allows for more stable movement of the foot pedal 104.

In order to allow for movement of the foot pedals 104 on the foot link 108 with the respective axles 306, 308 and 336, a space, slot, or passage is milled or formed in the webs 154 and 156 which can be seen as a slot 360. The slot 360 allows for passage of the axles 306, 308 and 336 as the foot pedal 104 reciprocates backwardly and forwardly in the channels 162 and 164. The clearance for the axles 306, 308 and 336 allows the travel backwardly and forwardly.

Figure 4:
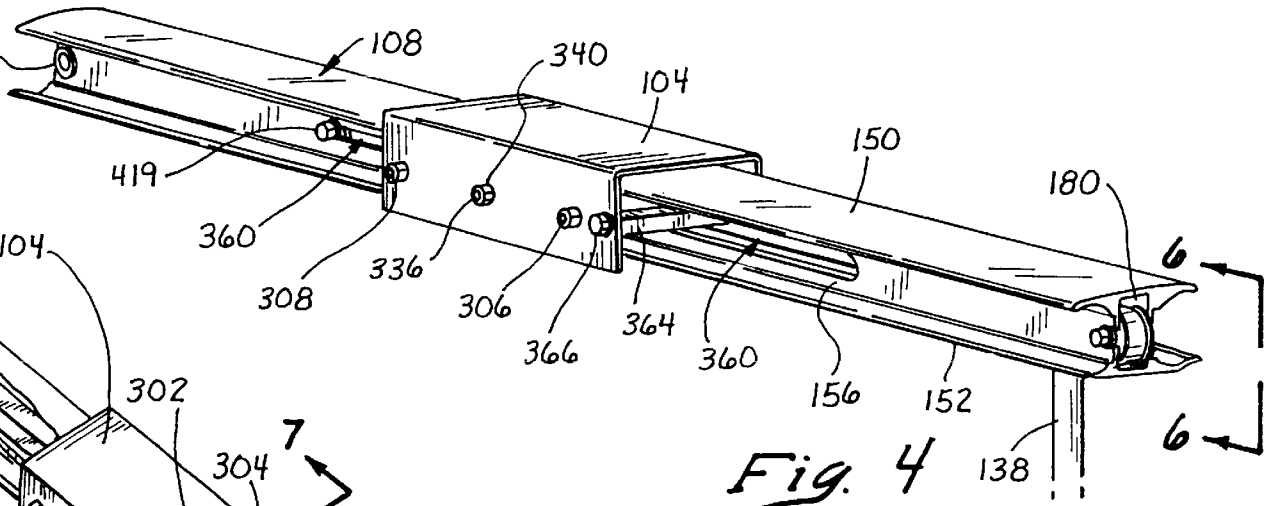
FIG. 4 shows a foot link and foot pedal in the form of a perspective side view.
Figure 3:
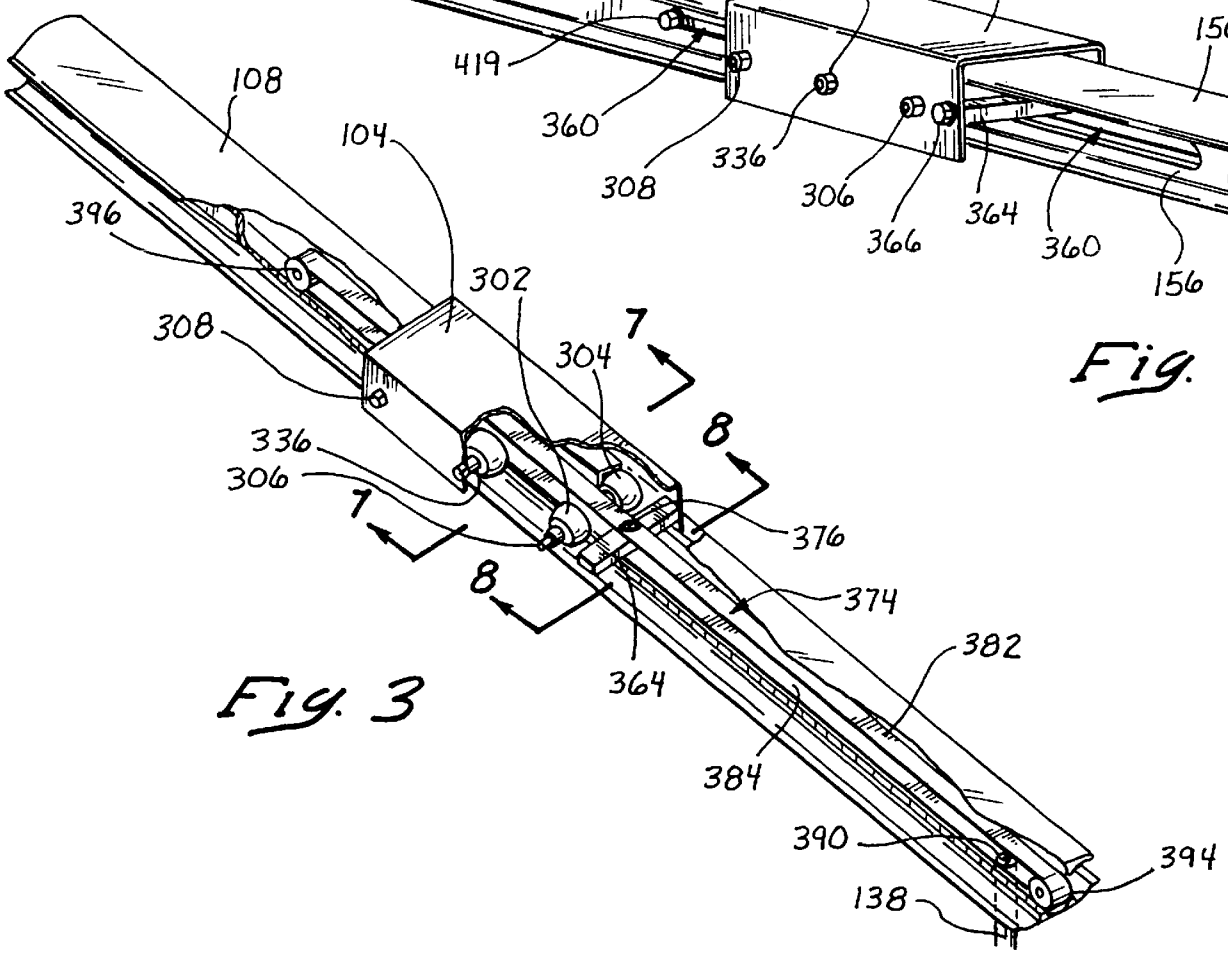
FIG. 3 shows a fragmented partially sectioned view of the foot link of this invention with the foot pedal connected thereto incorporating the flexible member that causes the foot pedal to be moved in relative movement to the foot link.

Looking at FIGS. 3, 4 and 8, it can be seen that a flexible member anchor, securement or strap brace 364 is shown. This anchor 364 is anchored by means of a nut 366 on either side or in the alternative, the rectangular anchoring means can be formed a rectangular through bolt having nuts 366 on either side. The anchoring member or cross member 364 is connected to an elongated flexible member 374. The elongated flexible member 374 is secured to the anchoring member 364 in this case by means of a bolt 376 and washer 378. However, the flexible member 374 can be clamped, cinched or in any way affixed to the foot pedal 104 in a suitable manner so that it is secured thereto and moves with and can pull the foot pedal 104.

The bolt or screw attaching to the anchor 364 can be seen in FIG. 8 as the bolt head 376 with the washer 378. The flexible member 374 passes through the tunnel elongated opening or passage 180 and can be seen with its upper portion 382 and lower portion of the flexible member belt or cable 384. These respective upper and lower portions as can be seen are such wherein the upper portion 382 is anchored by the anchoring means in the form of the screw and washer to the cross member 364. However, it can be anchored by any suitable means so long as it is able to move drive and/or pull the foot pedal 104 in the manner as described hereinafter.

The lower portion of the flexible member belt or cable 384 is anchored to the ground 138 as previously mentioned. Thus, its affixation continues downwardly from the ground to the base of the frame through the structure as previously stated. This ground 138 extends as an extension upwardly and is connected to the lower portion by means of a bolt and washer configuration 390 similar to that of the bolt and washer or screw and washer 376 and 378. The securement can be in any suitable manner by clamping and holding the lower portion 384 so that it is fixed with regard to the ground position 138 and such that it does not move therefrom in any appreciable manner.

The flexible member 374 is wrapped around a pair of belt pulleys or sheaves respectively at the back and distal therefrom toward the front. These respective pulleys or sheaves comprise a back belt pulley 394 and a front pulley 396. This is also seen graphically in FIG. 6 wherein the back or rearward belt pulley 394 has a pair of flanges 395 and 397 on either side thereof. These flanges 395 and 397 serve to hold the belt 374 in a central position on the belt pulley. In order to journal the rearward belt pulley 394, it can be seen that a bolt or other journaling means passes through the center thereof having bearings. In this case, the bolt comprises a bolt 401 with a head 403 and a nut 405 to secure the belt pulley 394 thereto.

In like manner, the belt pulley 396 is secured similarly to the side walls of the inside of the channels namely side walls 154 and 156. This can be seen wherein the sheave or pulley flanged side walls analogous to those shown on the rear belt pulley 394, namely flanged side walls 409 and 411 are shown in FIG. 7 within the tunnel or elongated cavity 180. The belt pulley 396 is journaled on an axle with bearings seen in FIG. 7 and partially seen in FIG. 4 with a nut 419 securing the axle.

These belt pulleys 394 and 396 which will be described hereinafter as belt pulleys to distinguish them from the other rollers comprise a sheave, turning means, or other element to allow the flexible member 374 to rotate around them as the foot link 108 moves, in a manner to be described.

It should be noted that the axis of the belt pulley 394 can not be moved any farther forward than the point of anchoring of the belt at the point where it is secured by securement 390 to the ground 138. Also to this extent, the belt pulley 396 can not be moved backwardly into the area of the foot pedal 104 to the point where it entangles or disorients the movement of the foot pedal by impinging or engaging against the forward axle 308 of the foot pedal. Within these constraints also it should be understood that the movement of the foot pedal 104 should be allowed to move with respect to the foot link 108 in a non-binding and free manner to provide for the increased stride of this invention in a manner so that it does not restrict the reciprocal movement of the foot links 106 and 108.

In effect, what happens, is as the foot link 108 moves backwardly, it tends to push the belt pulley 394 relative to the ground backwardly. This in turn pulls the flexible member backwardly so that the upper strap portion cable or other flexible member portion 382 tends to pull the foot pedal 104 backwardly due to the fact it is secured thereto at the connection or anchor 376. As it pulls the foot pedal 104 backwardly, it pulls it along the top of the foot link 108. At the same time, while pulling the top portion 382 of the flexible member, the bottom portion 384 tends to pay out and wrap around the belt pulley 396 as it moves around the axis thereof. The flexible member 374 is a continuous looped member so that it pulls by the relative motion of the belt pulley 394 driving it backwardly while feeding around the belt pulley 396.

As the foot link 108 moves forwardly, it moves the belt pulley 396 so as to pull forwardly the foot pedal 104. Thus, at this point the pulley 396 serves as a driving roller by pulling the connection point or anchor 376 and the attendant foot pedal 104 forwardly as the rear belt pulley pays out the upper portion 382 of the flexible member 374 forwardly. In this manner, relative motion is multiplied by a factor of four times the length of the crank arm 92 as will be seen in the crank arm description in the Figures described hereinafter. Other means to impart this relative motion within the foot link 108 can also be accommodated such as by the substitution of a rack and pinion respectively for the flexible member 374 and the belt pulleys 394 and 396. Also, aside from a rack and pinion and various cable configurations, it should be understood that levers and anchoring points can be utilized to enhance this principle of the doubling movement of the normal diameter sweep of the crank arms.

Figure 14:
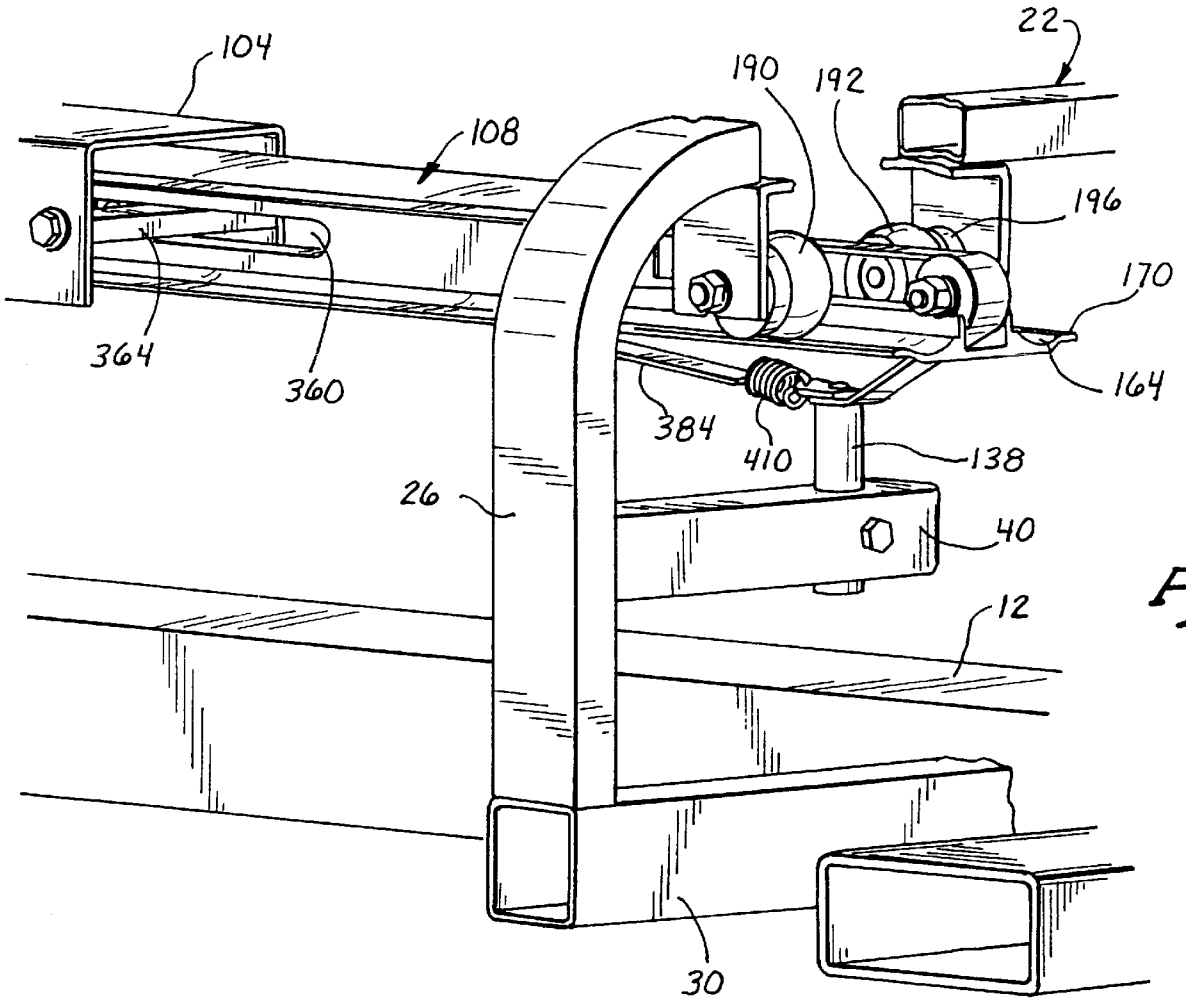
FIG. 14 shows a perspective fragmented broken away view of the rollers that support the foot link with the flexible member having a spring member inter-connected therewith.

Looking at FIG. 14, it can be seen that the rear support rollers 190, 192, 194 and 196 are shown. However, as an alternative, the ground point 138 is secured to the lower portion 384 of the flexible member in part by a spring. This spring allows for retention and belt flexibility so that the belt 374 is maintained in a tightened relationship. However, in general, it is believed that a tightened cable or other means will generally not require the spring tightening shown in FIG. 14. This spring tightening shown in FIG. 14 can not only be a coil spring 410 as shown therein but any other suitable means to take up slack.

Looking specifically at FIGS. 2, 9, 10, 11, and 12, it can be seen that the relative positions have been shown with regard to the crank arms, the foot link, the foot pedal, and the flexible member. The view is of a mid-line view of the foot link, foot pedal and flexible member within the foot link.

Figure 2:
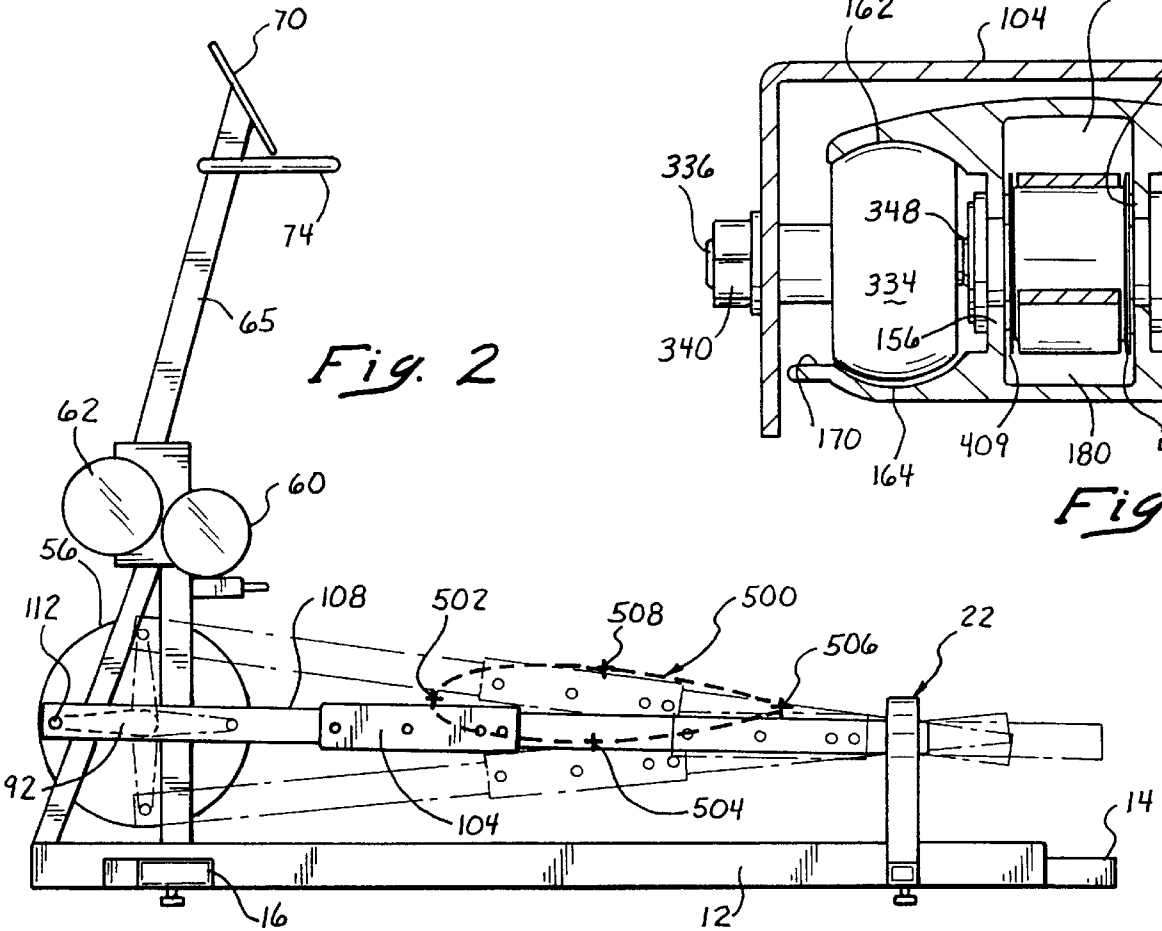
FIG. 2 shows a side elevation view of the exercise trainer of this invention with super-imposed movements of the foot links traveling through a reciprocal movement providing the respective foot pedal orientations as shown.

Looking more specifically at FIG. 2, it can be seen that the frame supporting the exercise trainer of this invention is shown. The respective foot pedals are shown in a dynamic traveling mode in a dotted configuration defined by a dotted curve 500. The dotted curve 500 is somewhat analogous to a degenerated ellipse. An ellipse as purely defined is an elongated circle: a regular oval; specifically: a closed plane curve generated by a point so moving that its distance from a fixed point divided by its distance from a fixed line is a positive constant less than 1. However, in this particular case it can be seen that this is fundamentally a degenerated ellipse 500 having an elongated or major axis between two particular points.

For illustration purposes initially the operation of the foot pedal is such wherein a user's foot at point 502 is when the crank 92 is in the horizontal position. The crank connector 112 is at the farthest position defined by approximately a point 90° counter clockwise from its top position. Also the position of a person's foot 502 is in the most forward position with regard to the foot pedal 104 on the foot link 108. As the foot pedal 104 is pushed downwardly, thereby orienting the crank an additional 90° so that the crank arm is moved 180° counter clockwise from the top position, the point of the foot 504 is moved backwardly. As the crank moves backwardly more with the relative movement of the foot pedal 104 moving backwardly the crank is approximately 270° in counter clockwise movement from the top position. At this point the foot position at point 506 is in its furthest position backwardly.

As the foot link 108 moves forwardly by the crank arm moving to the top position, the foot position 508 changes so that it is at the top of the modified ellipse. The modified ellipse 500 describes the foot and foot pedal 104 positions 502, 504, 506, and 508 respectively with regard to the crank positions. The modified dotted configuration 500 is such where it defines the movement as shown so that a smooth generally modified elliptical path is achieved. This somewhat corresponds to a running or jogging motion for movement rather than a mere straight up and down or sliding movement. It can also be noted that the position of the foot moving from position 502 to 506 is such wherein the major axis of the modified elliptical like configuration 500 is four times the crank length. Thus the overall multiplier effect of two creates an increase of a factor of four times the crank length.

Figure 9:
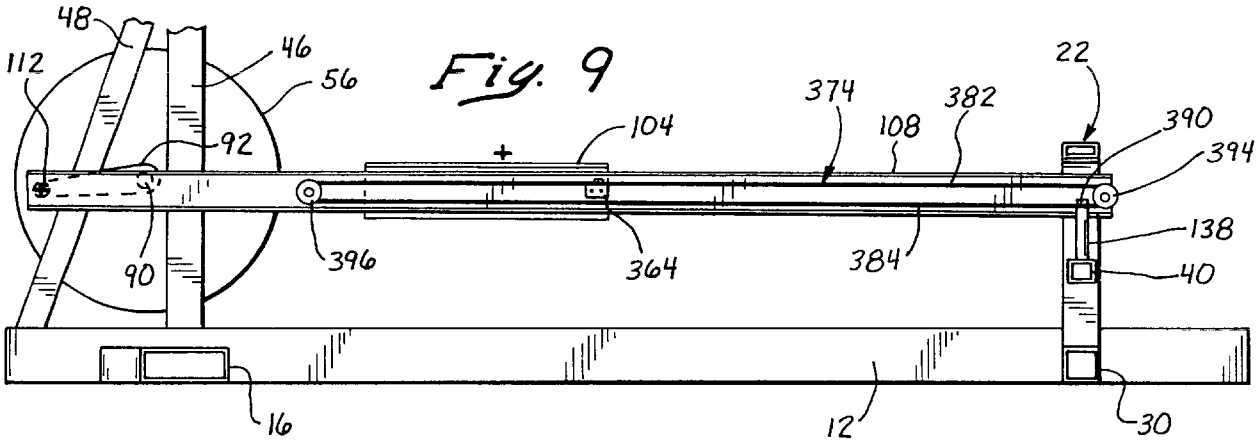
FIG. 9 shows a mid-line sectional view of the foot link and foot pedal starting from a level position with the crank arm fully extended forwardly.
Figure 10:
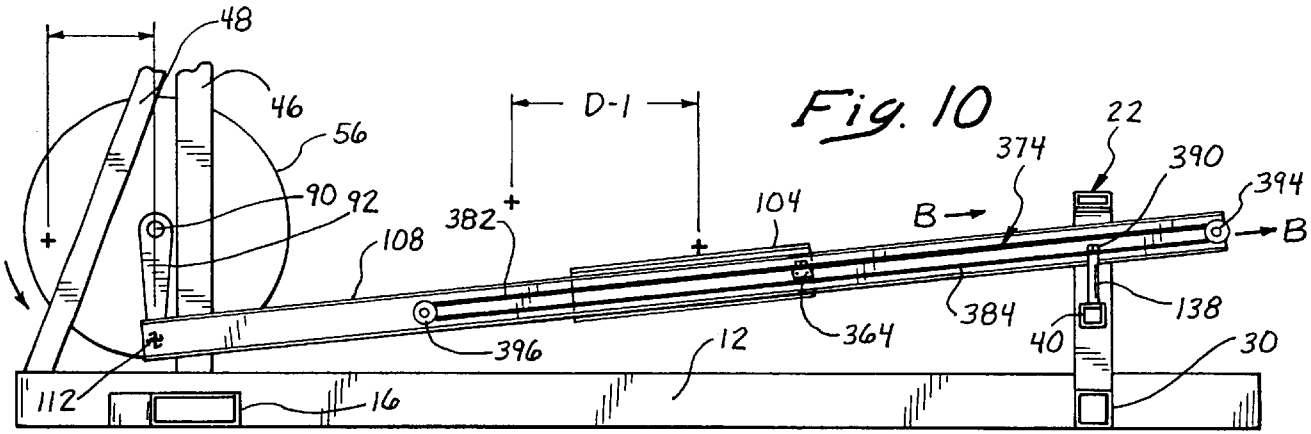
FIG. 10 shows a mid-line sectional view of the foot link and the foot pedal with the crank arm in its lowered position.

Looking more particularly at FIGS. 9, 10, 11, and 12 it can be seen that the relationship as defined in FIG. 2 is shown with regard to the movement of the flexible member 374. In order to orient the operation, the first position is shown in FIG. 9 and sequencing through FIGS. 10, 11, and 12.

FIG. 9 shows the crank in its most forward position which accordingly is the position of the foot link connected at its journaled bearing location 112. This is approximately at 90° from top center in a counter clockwise movement or at approximately nine o'clock. At this point, the foot pedal 104 and the location of a user's foot can be seen in the most forward position of the exercise movement.

The foot pedal 104 is then driven backwardly from its most forward position. It will now be seen wherein by moving to the position of FIG. 10, which is 90° from the prior position of FIG. 9, or approximately 180° from the top center position moving counter clockwise to six o'clock, that the foot link 108 has been moved backwardly. The foot pedal 104 has moved a given distance D1. This given distance D1 is accommodated by the belt pulley 394 being journaled to and driven by the foot link 108 backwardly in the direction of arrow B. This thereby pulls the upper portion 382 of the flexible member backwardly thereby pulling the anchor point 364 of the foot pedal backwardly so that the foot pedal 104 moves relatively along the top of the foot link 108.

Figure 11:
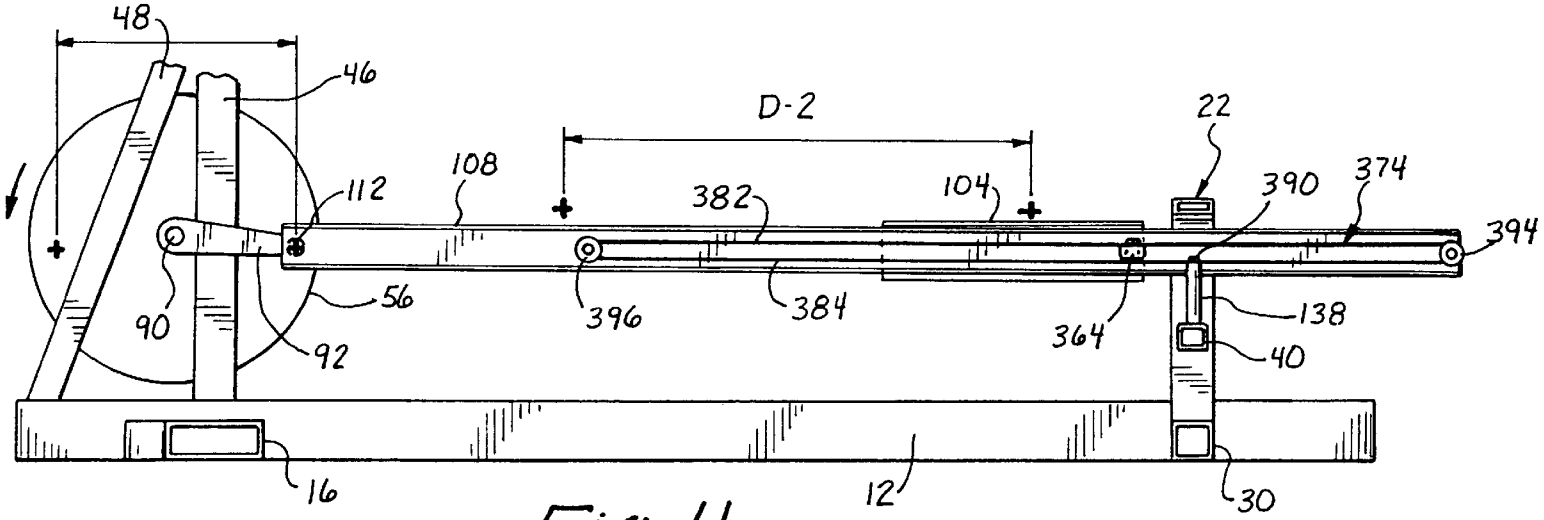
FIG. 11 shows a mid-line sectional view of the foot link and foot pedal with the crank arm in its rearward extended position and the foot link relatively flat.

As the foot link 108 moves farther backwardly, the foot pedal 104 also moves backwardly in relation thereto as shown in FIG. 11. In FIG. 11, the crank 192 has moved a full 270° from the top position or 180° backwardly to a position at three o'clock. The distance that the foot pedal moves is shown as D2. D2 is the distance of four times the crank length. From this point, with further movement, the foot pedal 104 then moves forwardly as seen in FIG. 12.

Figure 12:
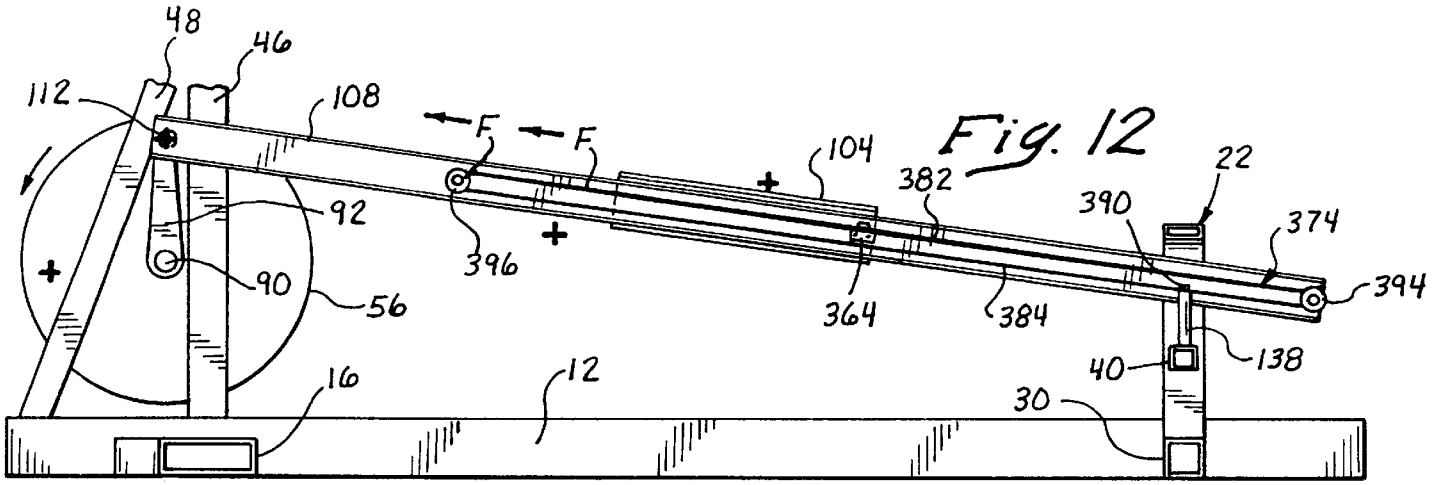
FIG. 12 shows a mid-line sectional view of the foot link and foot pedal with the crank arm in its full upright position.

In FIG. 12, the foot link 108 has moved forwardly to its top position or at twelve o'clock a full 270° from the position shown in FIG. 9. The distance and movement from the rear position of D2 is D2 minus D1 with the foot pedal being in the upper position. This is caused by the belt pulley 396 pulling the foot pedal 104 forwardly from its anchor point 364 due to the fact that the relative position of the belt pulley 396 is moving forwardly in the direction of arrow F.

The overall effect is to move the upper belt member 382 forwardly while feeding out the lower belt member 384 so that it travels around the belt pulley 394 in the opposite direction from the way it was traveling when the movement was in the direction of arrow B.

From the foregoing it can be seen that the overall movement of the foot pedal 104 has gone upwardly and downwardly in a roughly modified elliptical manner as shown by the outline 500 of FIG. 2. This makes a smooth curvilinear transition from the forward position indicated at point 502 on the foot pedal back to point 506 and then forwardly again to point 502. As can be understood, any principle involving such an effect by a rack and pinion or linkages substituting the flexible member 374 and the belt pulleys 394 and 396 can be utilized. Such means would be a rack and pinion or combination thereof in the alternative to belts and pulleys, cables, chains, or other means. Of course, chains can be effectuated with the utilization of sprockets or other means substituting for the belt pulleys 394 and 396. All the foregoing can effect the same movement of driving the foot pedal 104 backwardly and forwardly from its relative position on the foot link in relationship to ground as established by the ground 138 connected to the frame in its fixed location.

Figure 16:
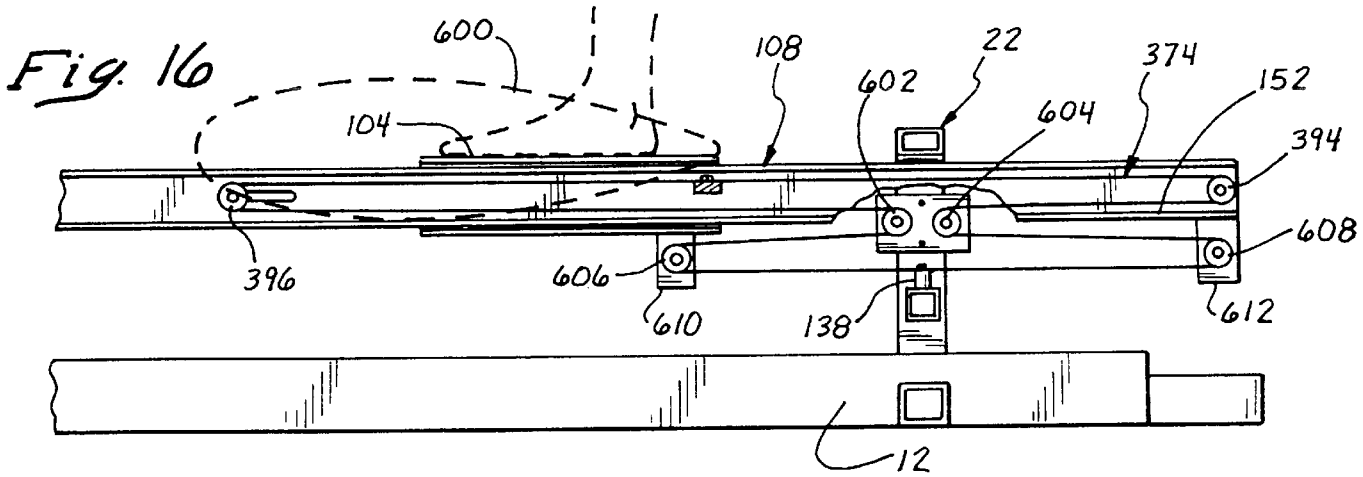
FIG. 16 shows a sectional view of a flexible member which can extend the crank length for reciprocating movement by a factor of just under six.
Figure 17:
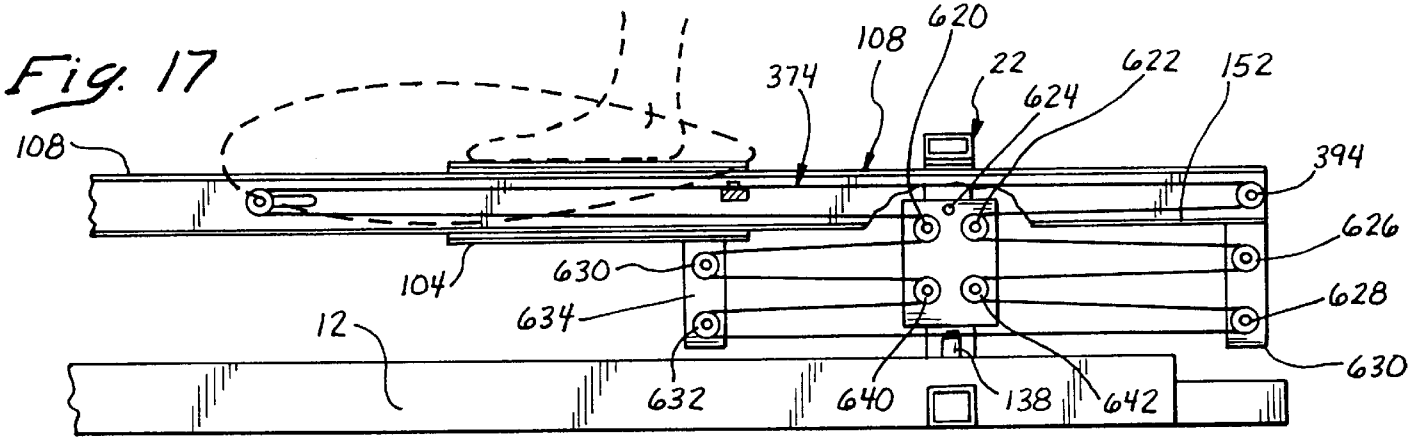
FIG. 17 shows a sectional view of a flexible member which can extend the crank length for reciprocating movement by a factor of just under eight.

Looking more specifically at FIGS. 16 and 17 it can be seen in FIG. 16 that a generally modified elliptical path 600 has been shown analogous to the prior modified elliptical path 500. In this particular instance, the flexible member has been provided in the manner of the normal flexible member 374 within the foot link 108 with the foot pedal 104 being placed on top of the foot link 108. Here again, pulleys 394 and 396 are in the same orientation as in the prior embodiment. However, in this particular case additional pulley sets are utilized with an additional belt link. In particular, this embodiment incorporates the ground point 138 to which the flexible member or belt is attached. However, a second set of pulleys 602 and 604 are utilized to allow the belt 364 to be fed around each particular pulley 602 and 604 to feed it downwardly. Pulley 602 and 604 are allowed to pivot as the foot link 108 travels upwardly and downwardly or oscillates in its upward and downward motion through its reciprocating movement.

Attached to the foot link in a fixed relationship is a third set of pulleys 606 and 608 that have an attachment in the form of a bracket 610 and 612 respectively for holding the pulleys 606 and 608. These particular brackets are fixed to the underside of the foot link, namely surface 152. The portion of the belt between pulleys 606 and 608 is affixed to a ground point 138 which is affixed to the frame so that it does not move. This particular arrangement provides for a multiplying effect of six times the length of the crank 92 attached to the foot link 108.

FIG. 17 shows an analogous multiplier which provides eight times the crank length distance. In this particular embodiment, a set of pulleys 620, 622, 640 and 642 are provided which are mounted on a plate that pivots around a pivoting pulley point at the axis thereof, namely pulley point 624.

A second set of pulleys 626 and 628 are attached to a bracket 630 which is rigidly mounted to the underside 152 of the foot link 108.

A third set of pulleys 630 and 632 are mounted to a bracket 634 that is connected to the foot link 108 underside 152 by the bracket so that they move in concert with the foot link. Here again, as analogous to the showing in FIG. 16 the portion of the flexible member 374 that extends between the pulleys 632 and 628 is secured to an analogous ground which is ground 138.

As the foot link 108 travels to the left a given distance, each belt portion connecting the pulley sets will increase a given distance in length. Since there are six connecting belts a single point on the belt next to the foot pedal travels six times that distance. The remaining distance to make up for the factor of eight is derived from the foot link itself moving with respect to the pedal. This provides for a movement of eight times the length of the crank 92.

From the foregoing description of the preferred embodiments, it can be seen that this invention provides significant multiplier effects for an exercise trainer without the need for various mechanical levers and other types of functional linkages. At the same time it provides a smooth movement of a user's foot on the foot pedal backwardly and forwardly and up and down so that aerobic training can be undertaken. Consequently, this invention should be read broadly in light of any claims hereto.

What is claimed is:

1. An exercise trainer to provide exercise movement to a user comprising:

a base a first crank arm and a second crank arm oriented at an angular distance from the other;

a first foot link connected to said first crank arm and a second foot link connected to said second crank arm;

foot pedals supported on said foot links for relative movement with respect to said foot links;

a bearing support for said foot links at a point removed from said first and second crank arms to which said first and second foot links are supported for sliding reciprocating movement; and, a connection between a grounded point on said base and said foot pedals interconnected with said foot links to provide relative movement to the ground of said foot pedals greater than twice the length of each respective crank arm.

2. The exercise trainer as claimed in claim 1 further comprising:

said connection is of a length to provide a movement of said foot pedals in the outline of a modified ellipse.

3. The exercise trainer as claimed in claim 1 further comprising:

said connection provides movement of said foot pedals of at least twice the crank length upon 90° of movement of the crank arm and at least four times the distance upon 180° of movement of the crank arm.

4. The exercise trainer as claimed in claim 1 wherein:

said connection comprises a rack and pinion.

5. The exercise trainer as claimed in claim 1 wherein:

said connection comprises a flexible member connected to said foot link by one or more pulleys around which said flexible member is placed at a point removed from the foot pedal.

6. The exercise trainer as claimed in claim 1 further comprising:

said first and second crank arms being connected to a flywheel on a common axis; and, means for providing a load on said flywheel during rotational movement.

7. An exercise trainer with a stride multiplier comprising:

a base;

first and second crank arms rotationally supported angularly apart on said base;

first and second foot links connected respectively to said first and second crank arms at one end and supported for sliding movement distally from said crank arms;

first and second foot pedals respectively supported for longitudinal movement on said first and second foot links; and, a connection between said foot pedals and a ground connection on said base and interconnected with said foot links so that said foot links when moved in supported relationship with said crank arms provide for a degenerated elliptical movement of said foot pedals such that a point on said foot pedals moves a distance with respect to ground greater than twice the length of its respective crank arm.

8. The exercise trainer as claimed in claim 7 further comprising:

said connection being a flexible member supported on a pulley to the rearward of said foot pedal and a pulley forward of said foot pedal.

9. The exercise trainer as claimed in claim 8 wherein:

said ground connection is at or behind the axis of the rearward pulley.

10. The exercise trainer as claimed in claim 7 wherein:

said crank arms are connected to a flywheel; and, said flywheel is connected to a load for providing a load on said flywheel.

11. An exercise trainer comprising:

a first and second crank arm having a common axis supported on a frame with a base, said first and second crank arm being angularly displaced from each other;

a flywheel connected to said crank arms;

a first foot link and a second foot link respectively supported on said first crank arm and said second crank arm;

a support for supporting said foot links removed from said first and second crank arm supports for reciprocal movement as said cranks are turned;

a first foot pedal on said first foot link and a second foot pedal on said second foot link supported for reciprocal movement on said foot link; and, a linkage between said foot pedal and said foot link and a fixed portion of said frame to provide reciprocal movement of said foot pedals through a degenerated ellipse having its major axis greater than the length of the crank arm to which it is supported.

12. The exercise trainer as claimed in claim 11 further comprising:

said linkage being formed as a belt wrapped at either end around a pulley and connected to said foot link.

13. The exercise trainer as claimed in claim 12 wherein:

said pulleys around which said linkage is wrapped comprise a rear pulley and a front pulley such that as said foot link moves, it moves the rear pulley when moving backwardly to drive said linkage backwardly to pull the foot pedal; and, said front pulley drives said linkage forwardly to pull said foot pedal forwardly when said foot link is moving forwardly.

14. An exercise trainer comprising:

a first crank arm and a second crank arm angularly offset from each other supported for rotational movement;

a first foot link connected to said first crank arm and a second foot link connected to said second crank arm;

a first foot receiving member and a second foot receiving member respectively connected for movement on said first foot link and said second foot link; and, a linkage between said first foot link and said foot receiving member interconnecting them, a linkage between said second foot link and said foot receiving member, both of said linkages connected to a fixed ground point so that said foot links when reciprocated cause said foot receiving members to reciprocally move on said foot links in relative displacement with respect to said ground.

15. The exerciser as claimed in claim 14 wherein:

said linkage comprises a flexible member.

* * * * *

UNITED STATES PATENT AND TRADEMARK OFFICE

CERTIFICATE OF CORRECTION

PATENT NO. : 6,575,877 B2
APPLICATION NO. : 09/740445
DATED : June 10, 2003
INVENTOR(S) : Rufino et al.

It is certified that error appears in the above-identified patent and that said Letters Patent is hereby corrected as shown below:

At column 16, line 21, after "comprising:" please add --a base--
At column 16, line 35, after "ground point" please add --on said base--
At column 16, line 38, please delete "said ground" and insert --a support surface -- in its place.

Please add new Claim 16, which was originally Claim 15. Claim 15 was identified as patentable in the Examiner's statement of reasons for allowance.

An exercise trainer comprising:
a base;
a first and second crank arm angularly apart from each other mounted on said base;
first and second foot links respectively connected to said first and second crank arms;
a bearing surface mounted on said base removed from said connection of said foot links to said crank arms providing reciprocal movement of said foot links;
a foot pedal mounted on each of said foot links having a bearing surface which engage said foot links for reciprocal movement with respect to said foot links;
a linkage between said foot pedals and said foot links; and
a securement for securing said linkage to a fixed portion on said base to provide relative movement of said foot pedals with respect to ground greater than twice the length of a crank arm, and in a degenerated elliptical path.

Signed and Sealed this

Eighth Day of August, 2006

JON W. DUDAS
*Director of the United States Patent and Trademark Office*